US006736083B2

(12) United States Patent
Frederick

(10) Patent No.: US 6,736,083 B2
(45) Date of Patent: May 18, 2004

(54) CANOE SEAT SUPPORT

(76) Inventor: James E. Frederick, 1334 2nd St., Southport, FL (US) 32409

( * ) Notice: Subject to any disclaimer, the term of this patent is extended or adjusted under 35 U.S.C. 154(b) by 0 days.

(21) Appl. No.: 10/229,684

(22) Filed: Aug. 27, 2002

(65) Prior Publication Data

US 2003/0024462 A1 Feb. 6, 2003

Related U.S. Application Data

(63) Continuation of application No. 09/844,158, filed on Apr. 27, 2001, now abandoned.

(51) Int. Cl.[7] ..... B63B 35/00
(52) U.S. Cl. ..... 114/347; 114/363
(58) Field of Search ..... 114/347, 363; 297/217.1

(56) References Cited

U.S. PATENT DOCUMENTS 2,815,517 A * 12/1957 Andresen ..... 114/363
3,718,365 A * 2/1973 Gibson ..... 297/344.24
4,493,285 A 1/1985 Williams ..... 114/363
4,641,594 A * 2/1987 Birkett ..... 114/43
4,766,838 A * 8/1988 Johnson ..... 114/363
5,101,753 A * 4/1992 Hull et al. ..... 114/345
5,168,825 A 12/1992 Ring ..... 114/363
5,590,619 A * 1/1997 Meador et al. ..... 114/363

OTHER PUBLICATIONS

Coleman Canoes and Accessories for Canoeing; Coleman RAM–X Canoes; Coleman Canoe Seats; Stadium/ Bot Seat Back/ Adjustable Canoe Seat/Coleman Add–on Passenger Seat; 1 page Dec. 19, 2001.

* cited by examiner

*Primary Examiner*—Stephen Avila
(74) *Attorney, Agent, or Firm*—Jackson Walker, L.L.P.

(57) ABSTRACT

A low centroid canoe seat support is provided which is mountable to a canoe and that receives a boat seat having standard three-quarter inch post pin. The canoe seat support holds the weight of the boat seat and a canoe rider in a position below the gunwales of the canoe and above the hull of the canoe, thus providing stability and reducing the likelihood of a capsizing event. Moreover, because the canoe seat support is compatible with standard post boat seats, the apparatus allows the rider to customize the canoe to meet his or her individual comfort and mobility needs.

7 Claims, 2 Drawing Sheets

CANOE SEAT SUPPORT

CROSS REFERENCE TO RELATED APPLICATIONS

The present application is a continuation of U.S. patent application Ser. No. 09/844,158 filed on Apr. 27, 2001 now abandoned.

BACKGROUND OF THE INVENTION

1. Field of the Invention

The present invention relates to the canoe seat industry and, more particularly, to a low centroid canoe seat support. The low centroid canoe seat support maintains a standard, rotatable boat seat having padded posterior support and padded back support, such that the centroid of a rider is positioned sufficiently low in the canoe to resist capsizing effects.

2. Description of the Prior Art

Many canoe seats and canoe seat supports have been developed in the past in an attempt to balance opposing goals of canoe stability and rider comfort. As the centroid, or center-of-mass, of the rider is raised to a position comfortable for the rider, the canoe becomes less stable and more conducive to capsizing.

U.S. Pat. No. 4,493,285 discloses a canoe backrest which is removably supported by the gunwales of the canoe and provides back support to the rider. However, this system requires the posterior of the rider to rest on the hull of the canoe. While this keeps the centroid of the rider sufficiently low, the rider is uncomfortably situated.

Alternatively, U.S. Pat. No. 5,168,825 discloses a canoe seat which provides for posterior support of the rider in a low centroid position, but fails to provide the rider with the comforts of back support.

Presently, Coleman markets a canoe rider support device which is marketed as the "Stadium/Boat Seat Back." This device attaches to an existing seat of a Coleman canoe and provides both posterior and back support. However, the rider is limited to using the seat back on a Coleman canoe and has no options to customize the canoe seat or seat back to his or her comfort and mobility needs.

For these reasons, it would be advantageous to have a canoe seat support which is compatible with a boat seat having a standard post, allowing the rider to utilize any seat that achieves the comfort and mobility requirements of the rider, while also resisting capsizing events.

SUMMARY OF THE INVENTION

A preferred embodiment of the low centroid canoe seat support in accordance with the present invention comprises an aluminum support that is affixed to the gunwales of a canoe. The support includes a horizontal member and two vertical members rigidly attached to the horizontal member. The vertical members are attached to the gunwales of the canoe such that the horizontal member is positioned below the gunwales of the canoe and above the hull of the canoe. The low centroid canoe seat support in accordance with the present invention also includes a cylindrical standard post receiver affixed to the horizontal member of the support and connectable with any seat having a standard post. The standard post receiver is positioned to support the weight of the seat and canoe rider below the gunwales of the canoe to promote operating stability and above the hull of the canoe to provide comfort to the rider.

DESCRIPTION OF SPECIFIC EMBODIMENT

The following illustrative description of the present invention is provided to facilitate an understanding of the invention, and is not intended to limit the present invention to any specific form.

Figure 1:
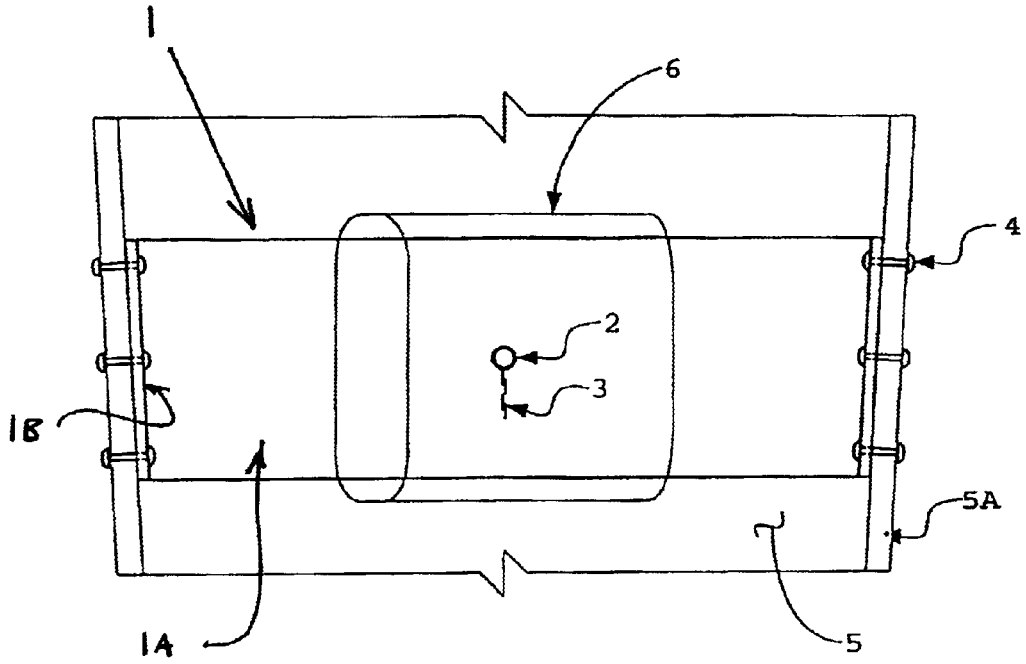
FIG. 1 is a plan view of a preferred embodiment of the present invention depicting a canoe, support, and boat seat with standard post.

With reference to FIG. 1, an embodiment of the present invention comprises a support carriage 1, a seat post receiver 2, a seat post receiver stiffener plate 3, and a support attaching means 4. While a preferred embodiment of the present device comprises components composed of aluminum, any other sturdy, corrosion-resistant material may be utilized including, but not limited to, stainless steel, galvanized steel, fiberglass, and polymer-based materials.

Still with reference to FIG. 1, the support carriage 1 comprises a horizontal member 1A and two vertical members 1B. The vertical members 1B of the support carriage 1 are attached to gunwales 5A of the canoe such that the horizontal member 1A is located below the gunwales 5A of the canoe and above the hull 5 of the canoe. The vertical members 1B of the support carriage 1 are preferably attached to gunwales 5A by bolts 4. However, any other attaching means may be utilized including, but not limited to, latch hooks, welds, rivots, and epoxy.

While this embodiment includes a support carriage having two vertical members attached to a horizontal member, in another embodiment of the present invention, the support carriage 1 is a bent plate having a horizontal section 1A and two vertical sections 1B.

Figure 2:
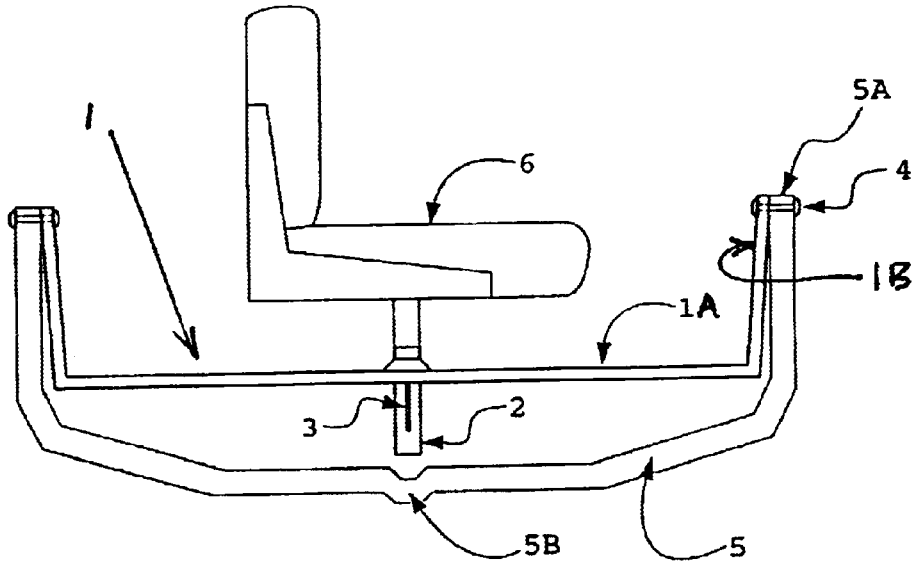
FIG. 2 is a section view of a preferred embodiment of the present invention depicting the canoe, support, and boat seat with standard post.

With reference to FIG. 2, a standard seat post receiver 2 is rigidly connected to the horizontal member 1A of the support carriage 1 such that the receiver is aligned with keel 5B of boat hull 5. A standard seat post 6A of seat 6 is removably connected with the seat post receiver 2. A preferred embodiment of the present device discloses a standard seat post receiver supporting a standard three-quarter inch diameter pin.

Figure 3:
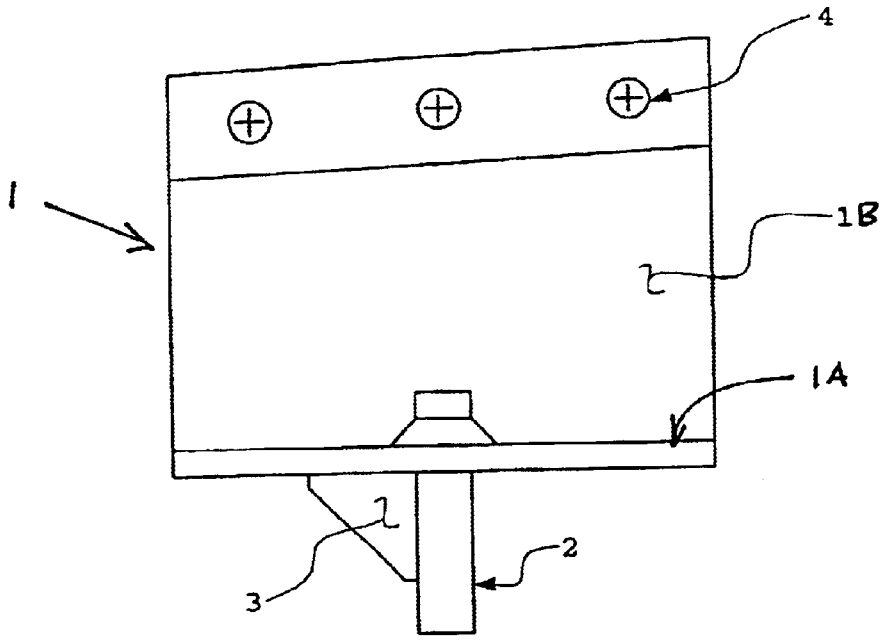
FIG. 3 is a section view of a preferred embodiment of the present invention depicting only the support.

With reference to FIG. 3, the seat post receiver 2 is braced to the horizontal member 1A of the support carriage 1 by a rigidly connected stiffener plate 3.

Figure 1A:
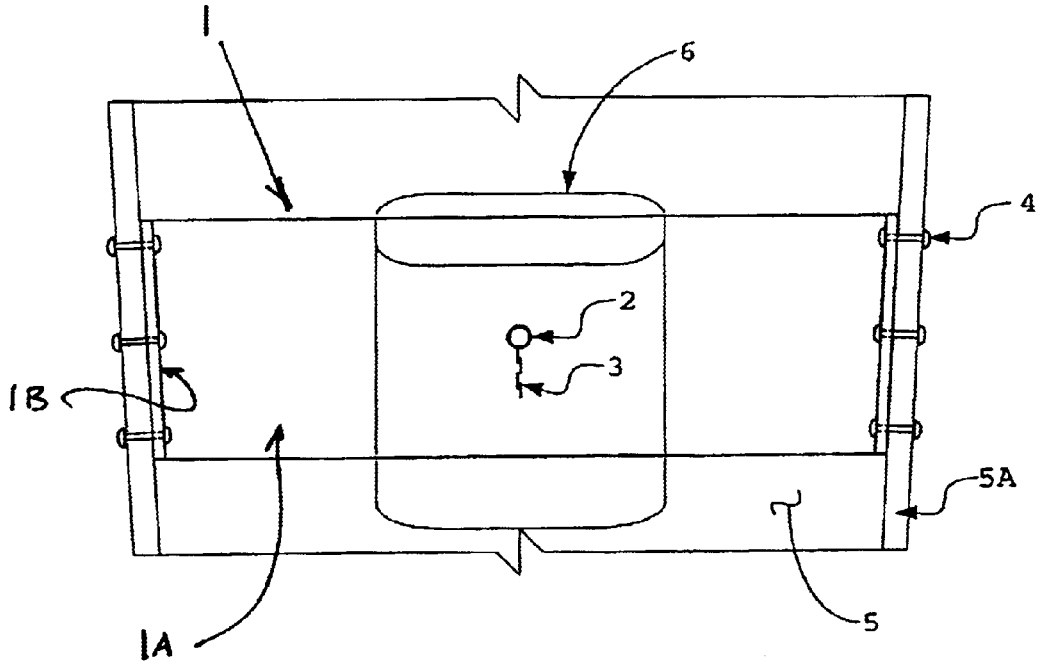
FIG. 1A is a plan view of a preferred embodiment of the present invention depicting the canoe, support, and boat seat with standard post, and depicting seat in rotated position.

With reference to FIGS. 1 and 1A, a standard post boat seat 6, is rotatably connected with the seat post receiver 2 permitting seat to swivel 360 degrees.

While the present invention is intended to provide a low centroid support for a standard boat seat (i.e., to support the weight of the boat seat and rider below the gunwales of the canoe), the present invention also provides the canoe with increased rigidity.

What is claimed is:

1. Apparatus in a canoe for supporting a boat seat having a standard post pin and a seating surface, comprising:

a support having a horizontal member with two vertical members rigidly attached at opposite ends of the horizontal member, said horizontal member having a width less than internal distance between the gunwales of the canoe and said vertical members having a vertical depth less than distance between the top of the gunwales and the hull floor of the canoe;

means for connecting the vertical members of the support to the gunwales of the canoe to position the horizontal member of the support below the gunwales of the canoe and above the hull floor of the canoe; and a receiving device which is affixed to the center of the horizontal member for engagement with the standard post pin of the boat seat; said receiving device supporting the pin of the boat seat below the gunwales of the canoe, whereby the seating surface of the boat seat is permitted to be located below the gunwales of the canoe, such that the centroid of a rider is positioned sufficiently low in the canoe to provide canoe stability and to resist capsizing events.

2. The apparatus of claim 1, wherein the receiving device is a cylindrical pipe welded to the center of the horizontal member of the support.

3. The apparatus of claim 2, wherein the cylindrical pipe is an aluminum pipe.

4. The apparatus of claim 3, wherein the pipe has an inside diameter of three-quarter inches.

5. The apparatus of claim 1, wherein said horizontal member and said vertical members comprise a bent plate.

6. The apparatus of claim 5, wherein said bent plate is aluminum.

7. The apparatus of claim 1, further comprising a boat seat having a three-quarter inch diameter post pin and both back and posterior support.

* * * * *